United States Patent [19]

Lehn

[11] Patent Number: 4,858,449

[45] Date of Patent: Aug. 22, 1989

[54] CHEMICAL SOLUTION DISPENSER APPARATUS AND METHOD OF USING

[75] Inventor: Chris F. Lehn, Minneapolis, Minn.

[73] Assignee: Ecolab Inc., St. Paul, Minn.

[21] Appl. No.: 817,350

[22] Filed: Jan. 9, 1986

[51] Int. Cl.[4] ..... D06F 39/02

[52] U.S. Cl. ..... 68/12 R; 68/17 R; 137/268; 134/93; 222/190

[58] Field of Search ..... 134/93; 222/190; 239/310; 68/17 R, 12 R; 137/268

[56] References Cited

U.S. PATENT DOCUMENTS

| | | | |
|---|---|---|---|
| 1,932,070 | 10/1933 | Grant et al. | 141/9 |
| 1,945,351 | 1/1934 | Grafton | 220/83 |
| 1,975,749 | 10/1934 | Lang | 141/9 |
| 2,120,807 | 6/1938 | Kundel | 299/34 |
| 2,138,943 | 12/1938 | Sinkwich | 141/9 |
| 2,308,612 | 1/1943 | Lehmkuhl | 23/272 |
| 2,370,609 | 2/1945 | Wilson et al. | 175/183 |
| 2,371,720 | 3/1945 | Stine | 299/83 |
| 2,382,163 | 8/1945 | MacMahon | 252/138 |
| 2,382,164 | 8/1945 | MacMahon | 252/138 |
| 2,382,165 | 8/1945 | MacMahon | 252/135 |
| 2,388,791 | 7/1942 | Culliton | 299/83 |
| 2,412,819 | 12/1946 | MacMahon | 252/138 |
| 2,614,574 | 10/1952 | Farrell | 137/268 X |
| 2,738,323 | 3/1956 | Tepas, Jr. | 210/28 |
| 2,820,701 | 1/1953 | Leslie | 23/271 |
| 3,070,316 | 12/1962 | Miville | 239/312 |
| 3,220,607 | 11/1965 | Seal | 222/54 |
| 3,253,741 | 5/1966 | Russell et al. | 222/52 |
| 3,307,744 | 7/1967 | Burford | 222/1 |
| 3,319,637 | 5/1967 | Gore et al. | 134/57 |
| 3,383,178 | 5/1968 | Dietz | 239/310 X |
| 3,592,538 | 7/1971 | Lugudin | 222/52 |
| 3,595,438 | 7/1971 | Daley | 222/67 |
| 3,653,543 | 4/1972 | Preikschat | 222/52 |
| 3,680,070 | 7/1972 | Nystuen | 340/244 |
| 3,727,889 | 4/1973 | Nagel | 259/1 R |
| 3,804,297 | 4/1974 | Jurjans | 222/54 |
| 3,850,344 | 11/1974 | Burge et al. | 222/67 |
| 4,020,865 | 5/1977 | Moffat et al. | 137/268 |
| 4,026,673 | 5/1977 | Russo | 137/269 X |
| 4,063,663 | 12/1977 | Larson et al. | 222/52 |
| 4,076,146 | 2/1978 | Lausberg et al. | 222/52 |
| 4,357,953 | 11/1982 | Patterson | 137/268 X |
| 4,426,362 | 1/1984 | Copeland et al. | 422/263 |
| 4,462,511 | 7/1984 | Fulmer et al. | 134/93 X |
| 4,462,967 | 7/1984 | Berelson | 134/93 X |
| 4,463,582 | 8/1984 | Saalmann et al. | 68/17 R |
| 4,687,121 | 8/1987 | Copeland | 68/17 R |

OTHER PUBLICATIONS

Economics Laboratory, Inc., Model C-4, pp. 1-2.
Economics Laboratory, Inc., C-33, Hydraulic Reservoir, p. 1.
Economics Laboratory, Inc., Detergent Reservoirs, pp. 1-2.
Economics Laboratory, Inc., Model C-11, pp. 1-2.
Economics Laboratory, Inc., Warhead Chlorinated Brick Detergent, p. 1.
Klenzade Products, Inc., Detergent Bricks, pp. 1-2.
Economics Laboratory, Inc., Model C-8, pp. 1-3.

*Primary Examiner*—Frankie L. Stinson
*Attorney, Agent, or Firm*—Merchant, Gould, Smith, Edell, Welter & Schmidt

[57] ABSTRACT

An automatic dispenser for dispensing solid chemicals used in cleaning processes which includes (i) means for initiating dispensing of a concentrated chemical solution, (ii) means for forming a concentrated chemical solution, (iii) means for directing the concentrated chemical solution to its utilization point, (iv) means for measuring the conductivity and temperature of the concentrated chemical solution dispensed, (v) means for calculating the amount of chemical dispensed based upon the conductivity and temperature of the concentrated chemical solution dispensed, and (vi) means for terminating formation of the concentrated chemical solution when a predetermined amount of chemical has been dispensed.

25 Claims, 5 Drawing Sheets

FIG. 6

Table of Conductivity versus Concentration for Common Solutions

| Weight % | ppm mg/litre | NaCl | NaOH | $NH_4OH$ | $NH_3$ | HCl | $H_2SO_4$ | $HNO_3$ | HF | $SO_2$ | Acetic* Acid |
|---|---|---|---|---|---|---|---|---|---|---|---|
| | Conductivity (G) $\mu$ S/cm ($\mu\Omega$/cm) at 25° C (77°F) | | | | | | | | | | |
| 0 .0001 | 1 | 2.2 | 6.2 | 4.1 | 6.6 | 11.7 | 8.8 | 6.8 | 10 | 6.4 | 4.2 |
| 0 .0003 | 3 | 6.5 | 18.4 | 8.3 | 14 | 35.0 | 26.1 | 20 | 30 | 18 | 7.4 |
| 0 .001 | 10 | 21.4 | 61.1 | 17 | 27 | 116 | 85.6 | 67 | 99 | 54 | 15.5 |
| 0 .003 | 30 | 64 | 182 | 31 | 49 | 340 | 251 | 199 | 290 | 150 | 30.6 |
| 0 .01 | 100 | 210 | 603 | 58 | 84 | 1140 | 805 | 657 | 630 | 450 | 63 |
| 0 .03 | 300 | 617 | 1780 | 102 | 150 | 3390 | 2180 | 1950 | 1490 | 1200 | 114 |
| 0 .01 | 1000 | 1990 | 5820 | 189 | 275 | 11100 | 6350 | 6380 | 2420 | 3600 | 209 |
| 0 .3 | 3000 | 5690 | 16900 | 329 | 465 | 32200 | 15800 | 18900 | 5100 | 7900 | 368 |
| 1.0 | 10000 | 17600 | 53200 | 490 | 810 | 103000 | 48500 | 60000 | 11700 | 17200 | 640 |
| 3.0 | Rarely Used | 48600 | 144000 | 790 | 1110 | 283000 | 141000 | 172000 | 34700 | 32700 | 1120 |
| 5.0 | ↓ | 78300 | 223000 | 958 | 1115 | 432000 | 237000 | 275000 | 62000 | 42000 | 1230 |
| 10.0 | | 140000 | 358000 | 1115 | 1120 | 709000 | 427000 | 498000 | 118000 | 61000 | 1530 |
| 20.0 | | 226000 | 414000 | 968 | 4351 | 850000 | 709000 | 763000 | 232300 | Sat | 1600 |
| 30.0 | | Sat | 292000 | 725 | Sat | 732000 | 828000 | 861000 | 390000 | Sat | 1405 |
| 40.0 | | Sat | 191000 | 760 | Sat | Sat | 770000 | 820000 | NA | Sat | 1080 |
| 50.0 | | Sat | 150000 | 285 | Sat | Sat | 620000 | 717000 | NA | Sat | 740 |
| 75.0 | | Sat | Sat | Sat | Sat | Sat | 182000 | 340000 | 7.8(0°C) | Sat | 168 |
| 100.0 | | Sat | Sat | — | <1 | Sat | 10000 | 50000 | 4(0°C) | <1 | <1 |
| Point of Maximum Solubility | | 26% | Abt. 50% | 13.6% (1 atm) | 28% (1 atm) | 37% | — | — | — | 11.7% (1 atm) | — |
| Point(s) of Maximum Conductivity | | 26% | 16% | 2.67% | 5.5% | 18.5% | 31 % / 92.5% | 31% | Abt. 35% | 11.7% | 19% |
| Maximum Conductivity | | 244000 | 412000 | (18°C) | (18°C) | 852000 | 830000 / 139000 | 862000 | NA | 66000 | 1600 |

Conductivity versus Concentration for Sodium Hydroxide (NaOH)

CHEMICAL SOLUTION DISPENSER APPARATUS AND METHOD OF USING

FIELD OF THE INVENTION

This invention relates generally to dispensers. More particularly the invention relates to dispensers which control the quantity of chemical dispensed by measuring the conductivity of a solution of the chemical. Most particularly the invention relates to dispensers which dispense solid chemicals used in cleaning processes which control the quantity of chemical dispensed by measuring the conductivity of a solution of the chemical.

BACKGROUND OF THE INVENTION

The utilization of automatic dispensers to dispense chemicals used in cleaning processes is well known in the art. The automatic dispensers may generally be placed into two broad categories based upon their method of controlling the amount of chemical dispensed; (1) time controlled dispensers, and (2) conductivity measurement dispensers.

Time controlled dispensers can only dispense solutions of known and/or constant concentration for if the concentration is unknown and variable different amounts of chemical will be dispensed during each cycle.

One example of a widely utilized method of dispensing a solution used in cleaning processes wherein the concentration of the solution dispensed will be unknown and variable is described in U.S. Pat. No. 4,063,663 issued to Larson et al, which is expressly incorporated by reference herein. Larson discloses a dispenser wherein water is sprayed onto and dissolves the downward facing surface of a granular detergent for use in a washing machine.

In attempts to control the quantity of chemical dispensed when the concentration of the solution is unknown or variable the relationship between solution concentration and temperature and conductivity of the solution can be utilized.

For example, the effect of concentration and temperature upon the conductivity of sodium hydroxide solutions is presented in the table and graph of FIGS. 6 and 7, respectively. Actual test data obtained from the dispensing system and the chemical dispensed will result in a generally observable and reproducible relationship between these three variables for that system.

Prior art devices control the quantity of chemical dispensed by measuring the conductivity of either (i) the wash water, or (ii) the concentrated chemical solution held in a reservoir with concentrated chemical solution being dispensed into the measured reservoir when the conductivity of the measured solution falls below a predetermined set value.

It is preferable to measure the conductivity of the concentrated chemical solution because: (i) the wash water contains contaminants such as soil which can affect the conductivity of the wash water, (ii) there can be a large time lag between dispensing of the concentrated chemical solution and sensing of the change in conductivity of the wash water made by the additional chemical, and (iii) automatic dispensing devices are generally sold separately from the washing machine with which they are to be used and conductivity measurement of the wash water requires the implantation of electrodes into the washing machine requiring additional labor, added expense, and increasing the chance of failure.

Measurement of the conductivity of concentrated chemical solution, used in the cleaning process, which is contained in a separate reservoir avoids the problems listed above but requires a separate reservoir to maintain concentrated chemical solution, increases the health hazards associated with the dispensing of chemicals used in the cleansing process as concentrated chemical solution is constantly present and may be spilled or splashed onto an operator, and requires an additional mechanism for time controlled dispensing of the concentrated chemical solution from the reservoir into the washing machine.

Accordingly, a need exists for a compact dispenser which can dispense a desired quantity of a chemical in an aqueous chemical solution of an unknown and/or variable concentration in a safe, simple and accurate manner.

SUMMARY OF THE INVENTION

The invention includes (i) means for initiating dispensing of a concentrated chemical solution at the appropriate time, (ii) means for forming a concentrated chemical solution, (iii) means for directing the concentrated chemical solution to its utilization point, (iv) means for measuring the conductivity and temperature of the concentrated chemical solution dispensed, (v) means for calculating the amount of chemical dispensed based upon the conductivity and temperature of the concentrated wash chemical solution dispensed, and (vi) means for terminating formation of the concentrated chemical solution when a predetermined amount of chemical has been dispensed.

In the preferred embodiment: (i) a washing machine emits an electronic control signal to a spray control valve to open a solvent supply line to flow of solvent therethrough; (ii) the feed line control valve opens and solvent flows at a generally constant flow rate to a spray nozzle wherein the solvent is sprayed upon and dissolves the solid or granular chemicals retainably held above the spray nozzle; (iii) the concentrated chemical solution is immediately collected and dispensed into the washing machine; (iv) the conductivity and temperature of the concentrated chemical solution is measured before it enters the washing machine; (v) a microprocessor, based upon the known constant flow rate of solvent, the measured conductivity and temperature of the concentrated chemical solution, and the length of time since either the dispensing began or the last conductivity and temperature measurement was taken, calculates the periodic amount of chemical which has been dispensed; (vi) the microprocessor calculates the total amount of chemical dispensed by summing the periodic amounts; (vii) steps (iv) through (vi) are repeated until the predetermined amount of wash chemical has been dispensed; and (viii) the microprocessor emits a control signal to the spray control valve, closing the spray control valve to solvent flow therethrough, thereby terminating formation of concentrated chemical solution and preparing the system for another dispensing cycle.

The present invention (i) may be utilized with concentrated chemical solutions of unknown and/or variable concentrations as it measures the quantity of chemical dispensed based directly upon the conductivity of the solution as it is coated, (ii) has virtually no lag time between dispensing and measurement as measurements are taken immediately following formation of the solution, (iii) is unaffected by contaminants found in the wash water as it measures conductivity prior to the concentrated solutions introduction into the wash water, (iv) does not require utilization of a separate reservoir for the concentrated solution as the concentrated solution is dispensed into the washing machine as it is formed, (v) does not retain concentrated solution as it is dispensed into the washing machine as it is formed, and (vi) does not require an additional mechanism for the time controlled dispensing of the concentrated solution.

DEFINITIONS

As the term is utilized herein, "utilization point" refers to the place wherein the chemical solution is utilized and performs its desired function and "utilization vehicle" refers to the apparatus wherein the chemical solution is utilized and performs its desired function.

As the term is utilized herein, "periodic amount"refers to that amount of wash chemical dispensed during a single period of an arbitrary duration.

BRIEF DESCRIPTION OF THE DRAWINGS

FIG. 6 is a table listing conductivity vs. concentration of several common solutions.

DESCRIPTION OF THE PREFERRED EMBODIMENTS

Figure 1:
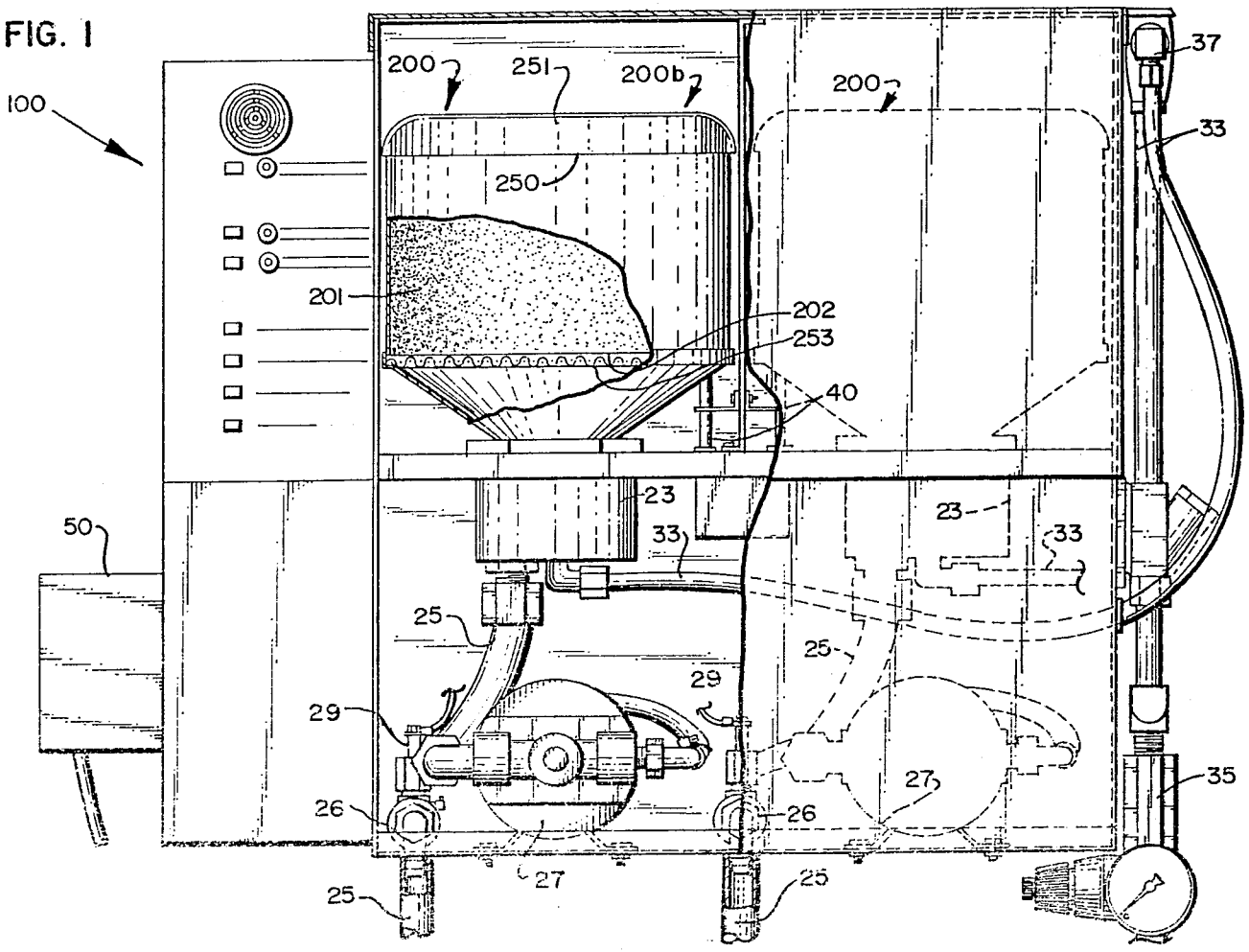
FIG. 1 is a front view of the dispenser of this invention for two chemicals.
Figure 3:
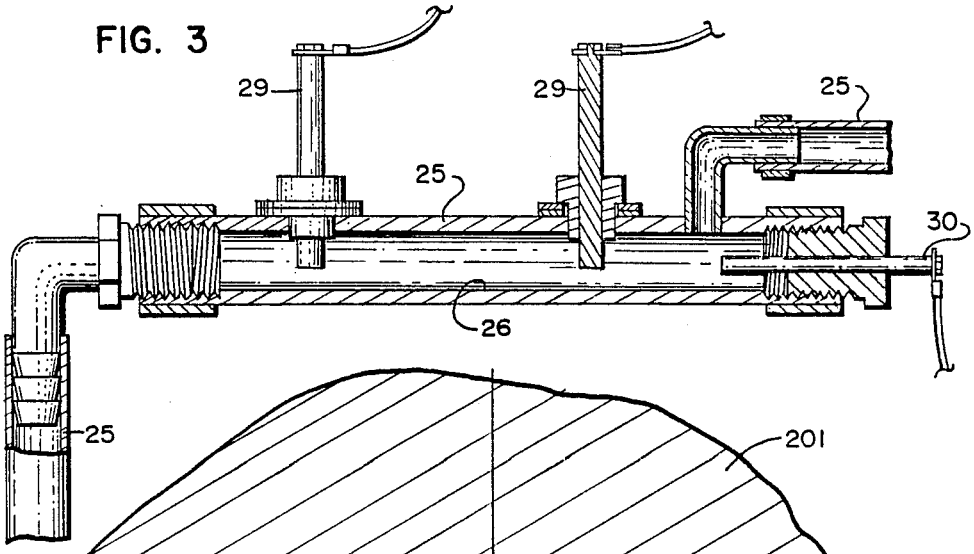
FIG. 3 is an expanded view, with portions thereof removed, of the solution conduit containing the electrodes and the temperature sensor.
Figure 2:
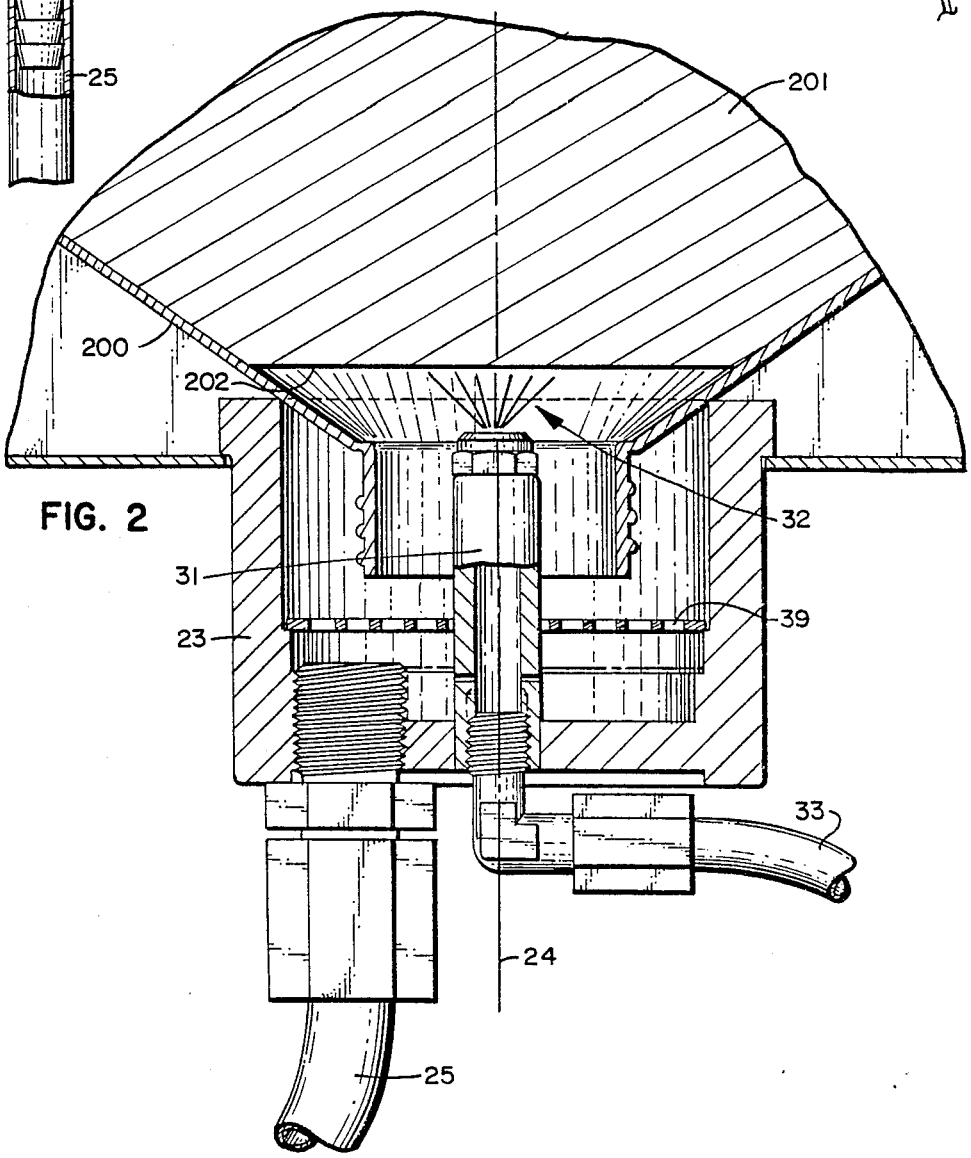
FIG. 2 is an expanded view, with portions thereof removed, of the collector, spray nozzle and portion of container with the access port.
Figure 4:
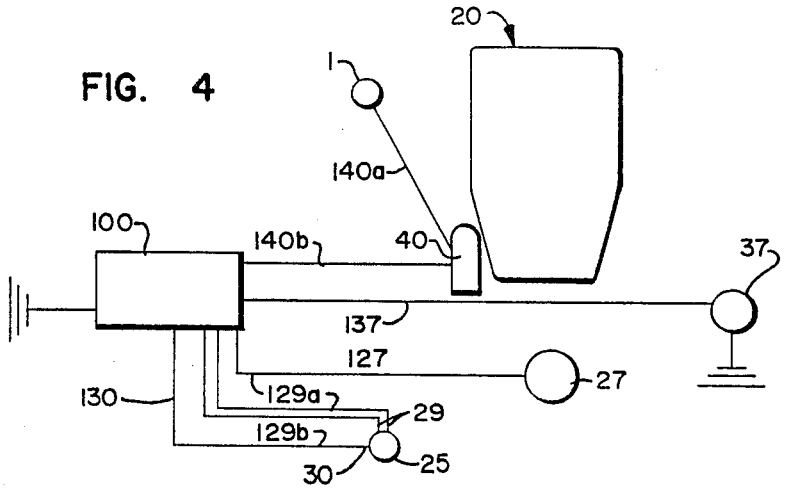
FIG. 4 is a schematic block diagram of the electrical flows.
Figure 5:
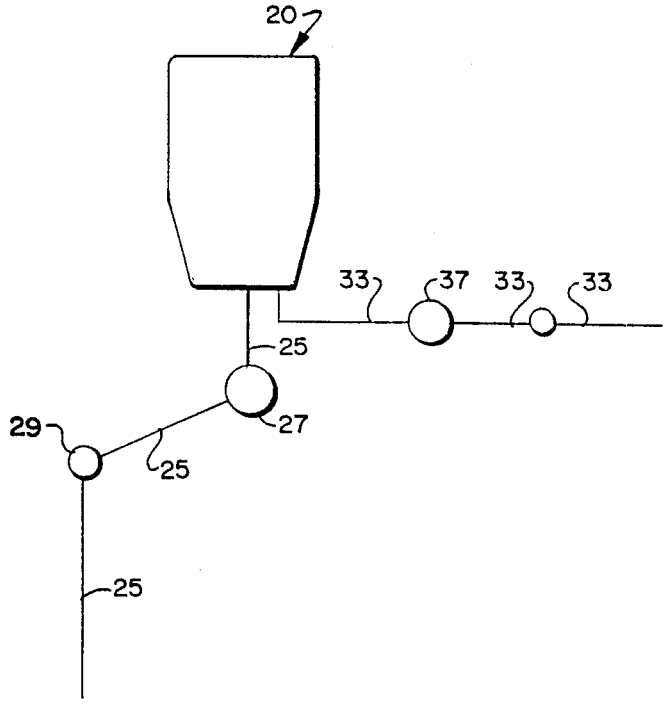
FIG. 5 is a schematic block diagram of the fluid flows.
Figure 7:
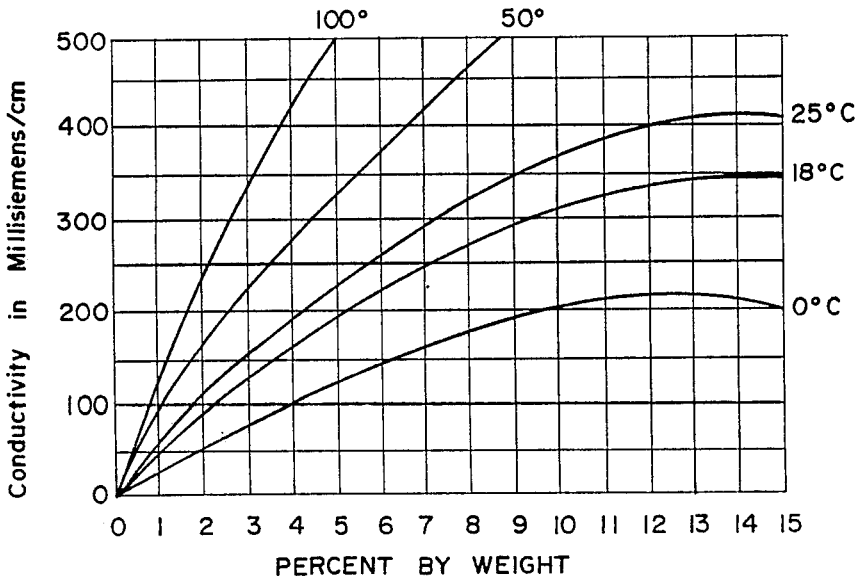
FIG. 7 is a graph depicting conductivity vs. concentration for sodium hydroxide solutions at several temperatures.

Referring to FIG. 1 there is generally disclosed a dispenser 20 for dispensing a concentrated chemical solution to a utilization point. The dispenser 20 operatively connected with an electronic control mechanism 100 for controlling the production of concentrated chemical solution # in the dispenser.

The dispenser 20 will be further described in terms of dispensing a solid cast detergent into a washing machine (not shown) which is the preferred embodiment. However, Applicant wishes to make clear that the dispenser works equally as well for the dispensing of any chemical to any utilization point so long as the solution's conductivity can be mathematically correlated to its concentration.

As best viewed in FIG. 1, the dispenser 20 comprises (i) a collector 23 to retain a disposable container 200 of solid chemical 201 and direct the concentrated wash chemical solution into a solution conduit 25, (ii) a solution conduit 25 to carry concentrated chemical solution from the collector 23 into the washing machine (not shown), (iii) in the preferred embodiment, a pump 27 operatively connected to the solution conduit 25 to pump the concentrated chemical solution through the solution conduit 25 and into the washing machine (not shown), (iv) a conductivity sensing means 29 operatively connected to the solution conduit 25 to measure the conductivity of the concentrated chemical solution directed into the washing machine (not shown), (v) in the preferred embodiment, a temperature sensing means 30 operatively connected to the solution conduit 25 to measure the temperature of the concentrated chemical solution directed into the washing machine (not shown), (vi) a spray nozzle 31 operatively engaged within the collector 23 to direct a spray of water into the disposable container 200 which is retained by the collector 23 for dissolving the chemical within the disposable container 200, (vii) a solvent feed line 33 connected to the spray nozzle 31 to supply the spray nozzle 31 with a pressurized source of water (not shown), (viii) a pressure regulating valve 35 operatively connected with the feed line 33 to maintain a constant flow rate of solvent to the spray nozzle 31, (ix) a control valve 37 operatively connected to the feed line 33 to open and close the feed line 33 to water flow therethrough in response to a control signal.

A second species of dispenser 20 utilizes a permanent container **200*b* with an upwardly disposed access port 250 for inserting additional chemical 201 into the container 200. The access port 250 covered with an upwardly disposed cover 251 and the chemical in the container 200 supported above the spray nozzle 31 by a support screen 253. The permanent container 200*b* may be refilled with wash chemical 201 thereby eliminating the need for multiple disposable containers 200*a***.

The collector 23 may be equipped with a lower screen 39 below nozzle 31 to prevent the passage of solid undissolved chemical 201 into the solution conduit 25.

The collector 23, disposable container 200, permanent container **200*b*, solution conduit 25, support screen 253 and lower screen 39** come in contact with the concentrated wash chemical solution and must therefore be made from a material which can withstand contact with the concentrated chemical solution without losing structural integrity. Materials which may be used include stainless steel, glass and thermoplastics such as polyethylene, polypropylene, polyvinyl chloride etc., with polypropylene being preferred because of its low cost and easy availability.

The concentrated chemical solution may be gravity fed or pumped into the washing machine (not shown). The size of the pump is preferably about 1/30 h.p. to about $\frac{1}{8}$ h.p.

Preferably, the conductivity 29 and temperature 30 sensing means are stainless steel electrodes 29 and a thermistor 30 respectively and are located near the lower inner surface 26 of the solution conduit 25 in order to maintain contact with the concentrated chemical solution flowing through the solution conduit 25 at all times. The cell constant of the electrodes 29 (distance between electrodes divided by cross-sectional area of solution between electrodes) is typically between 10 and 15/cm. with 11/cm. being the preferred cell constant.

Preferably, the spray nozzle 31 is positioned at the longitudinal center 24 of the collector 23 and the disposable container 200 or the permanent container **200*b* so that the water spray emitted by the spray nozzle 31 impinges upon substantially the entire lower surface area 202 of the chemical 201 stored in the container 200, thereby ensuring that all of the chemical 201 in the container 200** is utilized.

The pressure regulating valve 35 preferably maintains the solvent pressure fed to the spray nozzle 31 at a constant within the range of about 10 to 40 p.s.i., and most preferably in the range of about 15 to 25 p.s.i.

The functioning of the dispenser 20 is controlled by an electronic control mechanism 100 which is cooperatively connected to the feed line control valve 37, the pump 27, the conductivity sensing means 29, the temperature sensing means 30 and the washing machine (not shown) whereby in operation (i) the electronic control mechanism 100 receives an initiation signal from the washing machine (not shown) to begin dispensing, (ii) the electronic control mechanism 100 emits a control signal to the feed line control valve 37 along connection 137 to open the feed line 25 to water flow therethrough, (iii) the electronic control mechanism 100 emits a control signal to the pump 27 along connection 127 to begin pumping concentrated chemical solution, (iv) the conductivity sensing means 29 and temperature sensing means 30 emit measurement signals to the electronic control mechanism 100 along connections **129*a*, 129*b* and 130 respectively, (v) the electronic control mechanism 100 calculates the periodic amount of chemical 201 dispensed into the washing machine (not shown) based upon the known constant water flow rate, the period of time, the conductivity of the solution, and the temperature of the solution, (vi) the electronic control mechanism 100 calculates the total amount of wash chemical 201 dispensed into the washing machine (not shown) by summing up all the periodic amounts of chemical 201 dispensed, (vii) steps (iv) through (vi) inclusive are repeated until a predetermined amount of wash chemical 201 has been dispensed, and (viii) the electronic control mechanism 100 emits a signal to the feed line control valve 37 to stop the flow of solvent through the feed line 33**, thereby terminating the creation of concentrated chemical solution.

In order to reduce lag time and insure a more accurate calculation of the amount of chemical 201 dispensed into the washing machine (not shown), the periodic amount of chemical 201 dispensed is preferably calculated about every 1/50 to ½ second, and most preferably about every 1/20 second.

In the preferred embodiment the electronic control mechanism 100 is capable of determining when the container 200 or **200*b* is empty and warning the operator. This is preferably done by monitoring the total amount of chemical 201 dispensed. When the total amount of chemical 201 dispensed does not meet or exceed a first predetermined minimum amount within a first preset time period the electronic control mechanism 100 warns the operator that the container 200 or 200*b* is empty. This first preset time period will vary dependent upon how quickly the predetermined amount of chemical 201** is typically dispensed and should normally be about 1½to 3 times this value. Generally speaking, this preset time period will be in the range of about 2 minutes to about 5 minutes.

Preferably, as an additional less lengthy check to determine if the container 200 or **200*b* is empty, if the amount of chemical 201 dispensed does not meet a second predetermined minimum amount within a second preset minimum time period after dispensing of the chemical 201 is commenced, the electronic control panel 100 warns the operator that the container 200 or 200*b* is empty. The predetermined minimum amount of chemical 201 will vary dependent upon the particular chemical 201 but should be set well below the typical amount of that particular wash chemical 201 which is dispensed during the second predetermined minimum time period to avoid false readings. The second predetermined minimum time period is an arbitrarily set time period which should be long enough to ensure an accurate reading but not so long as to defeat the purpose of quickly warning the operator when the container 200 or 200*b*** is empty. The preferred second predetermined minimum time period is generally in the range of about 10 to 30 seconds.

Safety control switch 40 is operatively engaged with container 200 for sensing the relative movement of container 200 from complete sealing engagement with collector 23 for sensing when container 200 is jarred from a complete upright position over collector 23. Safety control switch 40 is operatively connected by conduction member **140*a* to a power source and by conduction member 140*b* to control valve 37. Control switch 40 is normally in an electrically open state preventing the passage of electricity from power source 2 to control valve 37, thereby preventing the passage of water through feed line 33. When container 200 is placed within collector 23, container 200 contacts safety switch 40 and depresses switch 40 creating an electrically closed switch 40 which thereby allows electrical power to flow from power source 2 to control valve 37 through electrical control panel 100 thereby allowing the flow of water through feed line 33**.

In a second embodiment a plurality of dispensers 20 connected to a single electronic control mechanism 100 may be utilized, each for a different chemical 201 and each independently responsive to a control signal from the electronic control mechanism 100 for dispensing the desired amount of chemical 201 at the desired time during the wash cycle. Such multiple containers 200 or **200*b*** may contain such different wash chemicals as detergent, bleach, softener, etc. wherein the detergent and bleach are dispensed during the wash cycle and the softener is dispensed during the rinse cycle.

One or more metering pumps 50 may be included in the present invention for dispensing liquid chemicals of a known concentration thereby allowing chemicals which cannot be formed into solid or granular form to be dispensed into the washing machine (not shown) at the desired time. Operation of the metering pump 50 is based upon a control signal from the electronic control mechanism 100 as to when to start and stop dispensing the liquid chemical solution. The preferred metering pump 50 is a peristaltic pump due to the caustic nature of many of the chemicals commonly used in the cleaning process.

EXAMPLE I

Accuracy of Dispenser

A container of "SOLID POWER" cast solid detergent whose composition is disclosed in copending U.S. patent application Ser. No. 06/234,940, was placed in the dispenser of this invention. The electronic control panel was set to (i) receive temperature and conductivity measurements, (ii) calculate the periodic amount of detergent dispensed every 1/20 second, (iii) sum the periodic amounts to determine the total amount of detergent dispensed every 1/20 second, and (iv) stop dispensing when the total amount of detergent dispensed was equal or greater than the predetermined desired amount.

The electrodes had a surface area of about 0.406 $cm^2$ and were placed about 4.45 cm apart for a cell constant of 11 cm. The water pressure flowing into the dispenser was regulated at approximately 15 p.s.i.

The following Table summarizes the predetermined amount of detergent programmed into the electronic control panel, the time period that the dispenser operated, and the volume of concentrated detergent solution dispensed.

TABLE 1

| | Predetermined Desired Amount (gms) | Operation Time (sec.) | Solution Dispensed (ml) |
|---|---|---|---|
| (1) | 80 | 24.5 | 1,260 |
| (2) | 80 | 26.0 | 1,320 |
| (3) | 80 | 28.6 | 1,325 |
| (4) | 120 | 98.6 | 4,700 |

A sample of the solution was then titrated using a 0.1N HCl solution as the standard.

The grams of detergent in the solution dispensed was calculated utilizing the following equation:

$$\text{Detergent dispensed (grams)} = (U)\frac{(S)}{(C)}\ \frac{1}{(100)} \text{ wherein;}$$

U=volume of concentrated solution dispensed;

S=volume of standard titrated to obtain the equivalence point (ph 8.3) of a 100 ml sample of concentrated chemical solution. (NOTE - If a 300 ml sample was titrated S will equal (Volume of Standard used/3);

C=a constant of 12.7 ml which is the volume of standard (0.1N HCl) required to reach the equivalence point (pH 8.3) for 100 ml of a 1.0 gram wt % "SOLID POWER" detergent solution (i.e., 12.7 ml of 0.1N HCl standard equates to 1 gram of detergent); and 100 converts the equation from percent to real numbers.

The sample size, volume of standard used to reach the equivalence point and calculated grams of detergent in the total solution are summarized in the following Table.

TABLE 2

| | Sample Titrated (ml) | Standard Titrated (ml) | Detergent Dispensed (G) |
|---|---|---|---|
| (1) | 300 | 226.8 | 75 |
| (2) | 300 | 245.3 | 85 |
| (3) | 200 | 149.5 | 78 |
| (4) | 200 | 67.0 | 124 |

The percent deviation of actual amount of detergent dispensed from the predetermined amount desired is:

(1) 6.2%
(2) 6.2%
(3) 2.5%
(4) 3.3%, indicating a margin of error well within the error range necessary to ensure efficient operation of the system.

EXAMPLE II

A second set of tests were conducted in accordance with the procedure disclosed in Example I except that instead of titrating a sample of the concentrated detergent formed, the container of detergent was weighed before and after dispensing to determine the amount of detergent dispensed. The resultant data is tabulated below.

| Predetermined Amount (G) | Weight Container Before Dispensing (G) | Weight Container After Dispensing (G) | Weight Detergent Dispensed (G) | Operation Time (Sec.) | Percent Difference |
|---|---|---|---|---|---|
| 120 | 1,487.5 | 1,371.5 | 116 | 89 | 3.3 |
| 120 | 1,371.5 | 1,245.5 | 126 | 65 | 5.0 |
| 120 | 1,245.5 | 1,123.5 | 122 | 67 | 1.7 |
| 120 | 1,123.5 | 1,011.5 | 112 | 61 | 6.7 |
| 120 | 1,011.5 | 885.5 | 126 | 108 | 5.0 |
| 120 | 1,488.2 | 1,381.2 | 107 | 58 | 10.8 |
| 120 | 1,381.2 | 1,269.2 | 112 | 70 | 6.7 |
| 120 | 1,813.1 | 1,694.7 | 118.4 | 97 | 1.3 |
| 120 | 1,694.7 | 1,572.4 | 122.3 | 73 | 1.9 |
| 80 | 1,572.4 | 1,488.7 | 83.7 | 53 | 4.6 |
| 80 | 1,488.7 | 1,415.7 | 73 | 53 | 8.7 |
| 80 | 1,629.9 | 1,554.9 | 75 | 41 | 6.2 |

The margin of error is generally less than 10% indicating a margin of error within that allowable for efficient operation of the system and as indicated by the large variance in time of dispensing necessary to achieve substantially the same amount of detergent dispensed, the dispenser is a substantial improvement over simple timed dispensers. p The foregoing description, Examples, and data are illustrative of the invention described herein, and should not be used to unduly limit the scope of the invention or claims. Since many embodiments and variations can be made while remaining within the spirit and scope of the invention, the invention resides wholly in the claims hereinafter appended.

I claim:

1. An improved chemical dispenser for dispensing a predetermined quantity of a chemical in a solution of unknown or variable concentration to a utilization vehicle which comprises:

(a) means for forming an aqueous solution of the chemical; and (b) an electronic control mechanism cooperatively connected to the utilization vehicle and the solution forming means, said electronic control mechanism including means for:

(i) receiving an initiating control signal to begin dispensing chemical solution into the utilization vehicle;

(ii) emitting a control signal to the solution forming means to begin dispensing chemical solution into the utilization vehicle;

(iii) continuously calculating the amount of chemical dispensed into the utilization vehicle by taking discrete measurements after predetermined time intervals, each measurement determining a periodic amount of chemical dispensed during the preceding time interval, said calculation means including means for measuring the conductivity of the aqueous solution of the chemical, said calculation means summing the periodic amounts to obtain a total amount of chemical dispensed and comparing the total amount to a predetermined amount of chemical to be dispensed; and (iv) emitting a control signal to the solution forming means to stop dispensing chemical solution when said predetermined amount of chemical has been dispensed.

2. The dispenser of claim 1 wherein:

(a) the solution forming means comprises:
(i) a collector for gathering the chemical solution;
(ii) a spray forming nozzle for directing a spray of solvent to dissolve the chemical;
(iii) a solution conduit connecting the collector with the utilization vehicle for directing concentrated chemical solution from the collector into the utilization vehicle;
(iv) a solvent supply line connecting the spray forming nozzle with a source of solvent;
(v) flow regulating means cooperative connected to the solvent supply line for maintaining a constant flow rate of solvent;
(vi) spray control means cooperatively connected to the solvent supply line for selectively controlling the flow of solvent to the nozzle and being operative in response to receipt of a control signal to open and close the solvent supply line to solvent flow; and
(vii) a conductivity sensing means cooperatively connected to the solution conduit for sensing the conductivity of the chemical solution flowing through the conduit and emitting a conductivity signal.

3. An improved chemical dispenser for dispensing a predetermined quantity of a chemical in a solution of unknown or variable concentration to a utilization vehicle which comprises:
(a) means for forming an aqueous solution of the chemical comprising:
(i) a collector for gathering the chemical solution;
(ii) a spray forming nozzle for directing a spray of solvent to dissolve the chemical;
(iii) a solution conduit connecting the collector with the utilization vehicle for directing concentrated chemical solution from the collector into the utilization vehicle;
(iv) a solvent supply line connecting the spray forming nozzle with a source of solvent;
(v) flow regulating means cooperative connected to the solvent supply line for maintaining a constant flow rate of solvent;
(vi) spray control means cooperatively connected to the solvent supply line for selectively controlling the flow of solvent to the nozzle and being operative in response to receipt of a control signal to open and close the solvent supply line to solvent flow; and
(vii) a conductivity sensing means cooperatively connected to the solution conduit for sensing the conductivity of the chemical solution flowing through the conduit and emitting a conductivity signal;
(b) an electronic control mechanism cooperatively connected to the utilization vehicle, the conductivity sensing means and the spray control means for:
(i) receiving an initiating control signal emitted by the utilization vehicle to begin dispensing chemical solution into the utilization vehicle;
(ii) emitting a control signal to the spray control means to open the solvent supply line to solvent flow therethrough;
(iii) receiving the conductivity signal emitted by the conductivity sensing means;
(iv) calculating a periodic amount of chemical dispensed into the utilization vehicle based upon the constant solvent flow rate, the length of the period and the conductivity of the chemical solution;
(v) calculating the total amount of chemical dispensed into the utilization vehicle by summing the periodic amounts;
(vi) repeating functions (iii) through (v) until a predetermined amount of chemical has been dispensed into the utilization vehicle; and
(vii) emitting a control signal to the spray control means to close the solvent supply line to solvent flow therethrough.

4. The dispenser of claim 1 wherein the chemical is a wash chemical.

5. The dispenser of claim 4 wherein the utilization vehicle is a washing machine.

6. An improved chemical dispenser for dispensing a predetermined quantity of a chemical in a solution of unknown or variable concentration into a utilization vehicle, which comprises:
(a) a means for forming a chemical solution comprising:
(i) a collector for gathering chemical having:
(A) an upper receiving means for retaining a container having an upper chemical storage portion and a lower passage; and
(B) a lower outlet port;
(ii) a spray forming nozzle for directing a spray of solvent into the upper storage portion of the retained container, dissolving that chemical carried immediately adjacent to the spray forming nozzle which passes in solution through the lower passage to the collector and is immediately directed by the collector through the outlet port;
(iii) a solution conduit connecting the outlet port with the utilization vehicle for directing concentrated chemical solution from the collector into the utilization vehicle;
(iv) a solvent supply line connecting the spray forming nozzle with a pressurized source of solvent;
(v) pressure regulating means cooperatively connected to the solvent supply line for maintaining a constant flow rate of solvent into the container;
(vi) spray control means cooperatively connected to the solvent supply line for selectively controlling the flow of solvent through the supply line to the nozzle and being operative in response to receipt of a control signal to open and close the solvent supply line to solvent flow;
(vii) a conductivity sensing means cooperatively connected to the solution conduit for sensing the conductivity of the chemical solution flowing through the conduit and emitting a conductivity signal; and
(viii) temperature sensing means cooperatively connected to the solution conduit for sensing the temperature of the chemical solution and emitting a temperature signal;
(b) an electronic control mechanism cooperatively connected to the utilization vehicle, the conductivity sensing means, the temperature sensing means, and the spray control means for:
(i) receiving an initiating control signal emitted by the utilization vehicle to begin dispensing chemical solution into the utilization vehicle;

(ii) emitting a control signal to the spray control means to open the solvent supply line to solvent flow therethrough;

(iii) receiving the conductivity signal emitted by the conductivity sensing means;

(iv) receiving the temperature signal emitted by the temperature sensing means;

(v) calculating the periodic amount of chemical dispensed into the utilization vehicle based upon the constant solvent flow rate, the length of the period, the temperature of the chemical solution and the conductivity of the chemical solution;

(vi) calculating the total amount of chemical dispensed into the utilization vehicle by summing the periodic amounts;

(vii) repeating functions (iii) through (vi) until a predetermined amount of chemical has been dispensed into the utilization vehicle; and (viii) emitting a control signal to the spray control means to close the solvent supply line to solvent flow therethrough.

7. The dispenser of claim 6 wherein the solvent comprises water.

8. The dispenser of claim 6 further comprising a screen interposed between the spray-forming nozzle and the outlet port for supporting undissolved laundry chemical falling from storage.

9. The dispenser of claim 6 further comprising:

(a) a solution pump operatively connected with the solution conduit for pumping concentrated laundry chemical solution into the washing machine and being operative in response to receipt of control signals to start and stop pumping; and (b) wherein the electronic control mechanism is cooperatively connected with the solution pump for emitting control signals to the solution pump to (i) start pumping when the water supply line is open to water flow, and (ii) stop pumping when the water supply line is closed to water flow.

10. The dispenser of claim 6 further comprising a liquid metering apparatus comprising:

(a) a metering pump for pumping a liquid concentrated laundry chemical into the washing machine and being operative in response to receipt of a control signal to start and stop pumping;

(b) a feed line connecting the metering pump with a source of liquid concentrated laundry chemical; and (c) a second conduit connecting the metering pump with the washing machine for directing liquid concentrated laundry chemical from the metering pump into the washing machine;

wherein the electronic control mechanism is cooperatively connected to the metering pump for (i) receiving and initiating a control signal emitted by the washing machine to begin dispensing laundry chemical solution into the washing machine, (ii) emitting a control signal to the metering pump to start pumping, and (iii) emitting a time based control signal to the metering pump to stop pumping.

11. The dispenser of claim 10 further comprising a plurality of liquid metering apparatuses each being independently operative in response to receipt of a control signal to start and stop pumping for supplying different liquid laundry chemicals.

12. The dispenser of claim 6 further comprising a safety control switch responsive to movement of the container to immediately block water spray from the nozzle whenever the container is tilted.

13. The dispenser of claim 6 further comprising an empty container signal to warn the operator when the total amount of chemical dispensed is not increasing.

14. The dispenser of claim 6 wherein the conductivity sensing means and the temperature sensing means are located near the lower inner surface of a horizontal portion of the solution conduit for insuring that the sensing means continually contacts the laundry chemical solution as it flows into the washing machine.

15. The dispenser of claim 6 wherein the periodic amount of laundry chemical dispensed into the washing machine is calculated every 1/50 to ½ of a second.

16. The dispenser of claim 6 further comprising a plurality of solution forming means, each being independently operative in response to receipt of a control signal to open and close the water supply line supplying that particular solution forming means for supplying different laundry chemicals.

17. An improved chemical dispenser for dispensing a predetermined quantity of a chemical solution of unknown or variable concentration into a washing machine, which comprises:

(a) a means for forming a homogeneous aqueous chemical solution comprising:

(i) a container having an upper storage portion for retaining a mass of a laundry chemical and a collector portion integral with and extending continuously downward from the upper storage portion and terminating at a lower outlet port from the container;

(ii) means for mounting the container to a vertical surface;

(iii) a spray forming nozzle operatively engaged to the container for directing the spray of water into the upper storage portion of the container, dissolving that laundry chemical carried immediately adjacent to the spray forming nozzle which passes in solution to the collector portion and is immediately directed by the collector portion through the outlet port;

(iv) a solution conduit connecting the outlet port with the washing machine for directing concentrated laundry chemical solution from the collector portion of the container into the washing machine;

(v) a water supply line connecting the spray forming nozzle with a pressurized source of water;

(vi) pressure regulating means cooperatively connected to the water supply line for maintaining a constant flow rate of water into the container;

(vii) spray control means cooperatively connected to the water supply line for selectively controlling the flow of water through the supply line to the nozzle and being operative in response to receipt of a control signal to open and close the water supply line to water flow;

(viii) a conductivity sensing means cooperatively connected to the solution conduit for sensing the conductivity of the laundry chemical solution flowing through the conduit and emitting a conductivity signal; and (ix) temperature sensing means cooperatively connected to the conduit for sensing the temperature of the laundry chemical solution and emitting a temperature signal; and (b) an electronic control mechanism cooperatively connected to the washing machine, the conductivity sensing means, the temperature sensing means, and the spray control means for:

(i) receiving an initiating control signal emitted by the washing machine to begin dispensing laundry chemical solution into the washing machine;

(ii) emitting a control signal to the spray control means to open the water supply line to water flow therethrough;

(iii) receiving the conductivity signal emitted by the conductivity sensing means;

(iv) receiving the temperature signal emitted by the temperature sensing means;

(v) calculating the periodic amount of laundry chemical dispensed into the washing machine based upon the constant water flow rate, the length of the period, the temperature of the laundry chemical solution and the conductivity of the laundry chemical solution;

(vi) calculating the total amount of laundry chemical dispensed into the washing machine by summing the periodic amounts;

(vii) repeating functions (iii) through (vi) until a predetermined amount of laundry chemical has been dispensed into the washing machine; and (viii) emitting a control signal to the spray control means to close the water supply line to water flow therethrough.

18. The dispenser of claim 17 further comprising a screen interposed between the spray-forming nozzle and the outlet port for supporting undissolved laundry chemical falling from storage.

19. The dispenser of claim 17 further comprising:

(a) a solution pump operatively connected with the solution conduit for pumping concentrated laundry chemical solution into the washing machine and being operative in response to receipt of control signals to start and stop pumping; and (b) wherein the electronic control mechanism is cooperatively connected with the solution pump for emitting control signals to the solution pump to (i) start pumping when the water supply line is open to water flow, and (ii) stop pumping when the water supply line is closed to water flow.

20. The dispenser of claim 17 further comprising a liquid metering apparatus comprising:

(a) a metering pump for pumping a liquid concentrated laundry chemical into the washing machine and being operative in response to receipt of a control signal to start and stop pumping;

(b) a feed line connecting the metering pump with a source of liquid concentrated laundry chemical; and (c) a second conduit connecting the metering pump with the washing machine for directing liquid concentrated laundry chemical from the metering pump into the washing machine;

wherein the electronic control mechanism is cooperatively connected to the metering pump for (i) receiving and initiating a control signal emitted by the washing machine to begin dispensing laundry chemical solution into the washing machine, (ii) emitting a control signal to the metering pump to start pumping, and (iii) emitting a time based control signal to the metering pump to stop pumping.

21. The dispenser of claim 17 further comprising a safety control switch responsive to movement of the container to immediately block water spray from the nozzle whenever the container is tipped to prevent escape of laundry chemical solution from the dispenser.

22. The dispenser of claim 17 further comprising an empty container signal to warn the operator when the total amount of chemical dispensed is not increasing as rapidly as is normal.

23. The dispenser of claim 17 wherein the conductivity sensing means and the temperature sensing means are located near the lower inner surface of a horizontal portion of the solution conduit for insuring that the sensing means continually contacts the laundry chemical solution as it flows into the washing machine.

24. The dispenser of claim 17 wherein the periodic amount of laundry chemical dispensed into the washing machine is calculated every 1/50 to ½ of a second.

25. The dispenser of claim 17 further comprising a plurality of solution forming means each being independently operative in response to receipt of a control signal to open and close the water supply line supplying that particular solution forming means for supplying different laundry chemicals.

* * * * *